United States Patent [19]

Ishikawa et al.

[11] Patent Number: 4,796,041

[45] Date of Patent: Jan. 3, 1989

[54] FILM FEED UNIT FOR USE IN AUTOMATIC FILM DEVELOPING MACHINE

[75] Inventors: Masazumi Ishikawa, Wakayama; Mitsuji Kawashima, Arida, both of Japan

[73] Assignee: Noritsu Kenkyu Center Co., Ltd., Wakayama, Japan

[21] Appl. No.: 54,969

[22] Filed: May 28, 1987

[30] Foreign Application Priority Data

May 29, 1986 [JP] Japan ..... 61-126852
May 31, 1986 [JP] Japan ..... 61-83243[U]

[51] Int. Cl.[4] ..... G03D 3/08

[52] U.S. Cl. ..... 354/320; 226/92; 226/188; 226/194

[58] Field of Search ..... 354/320, 321, 322; 226/188, 189, 91, 92, 190, 194

[56] References Cited

U.S. PATENT DOCUMENTS 3,078,024 2/1963 Sardeson ..... 226/189
4,295,728 10/1981 Nishimoto ..... 354/321
4,613,221 9/1986 Takase et al. ..... 354/321
4,666,279 5/1987 Fujita ..... 354/320

FOREIGN PATENT DOCUMENTS 2579778 10/1986 France ..... 354/322

*Primary Examiner*—A. A. Mathews
*Attorney, Agent, or Firm*—Armstrong, Nikaido, Marmelstein & Kubovcik

[57] ABSTRACT

A rack of a film feed unit for an automatic film developing machine is formed by two rack plates, one of which is formed in its side plates with cutouts. Film feed members can be easily mounted on the rack plate by inserting its ends into the cutouts from the front of the side plates. Also, each rack plate may be divided into a plurality of blocks, each having one end formed with grooves and the other end with projections to be engaged in the grooves to combine the blocks together. Thus, by changing the number of blocks to be coupled together, the length of the rack can be adjusted to the depth of a treating tank in which it is to be hung. Also provided in the rack are members for preventing films from meandering while being fed to the rack.

2 Claims, 6 Drawing Sheets

FILM FEED UNIT FOR USE IN AUTOMATIC FILM DEVELOPING MACHINE

The present invention relates to a film feed unit for use in an automatic film developing machine.

Generally, the development of color photographic films with an automatic developing machine cmmprises the steps of treating the films with a developer, bleaching agent, fixer and stabilizing agent with rinsing steps interposed therebetween as necessary. Also, it is a recent trend to use a developing machine in which the films are treated with a rinse containing an agent for stabilizing a sensitised material instead of the conventional rinsing with water.

FIG. 9 shows one example of such a type of developing machine. This developing machine 70 is provided with a developing tank 71, bleaching tank 72, fixing tank 73, rinsing tank 74 and stabilizing tank 75 arranged in the order of steps. Films are immersed in the treatment liquids in the tanks in sequence for development. The films taken out of the stabilizing tank 75 are then transferred to a dryer box 76 for drying. Such an automatic film developing machine is provided with film feed units 80 to feed films through tanks.

When feeding films F, they are connected at its tip to a leader L which is formed with square holes H longitudinally aligned at equal intervals, as shown in FIG. 12.

As shown in FIGS. 10 and 11, a prior art film feed unit is usually provided in its rack 81 with a film feed mechanism 82 and a means 83 for preventing the films from meandering or running out of true.

A known film feed mechanism 82 shown in FIG. 10 is provided with a plurality of roller shafts 84 arranged at equal intervals in the rack 81. Each roller shaft 84 is provided with a sprocket 85 and a pair of hourglass-shaped crown rollers arranged at both sides of the sprocket 85. The leader L guided into the rack 81 is fed down along the inner surface of the rack 81 by the rotation of the roller shafts 84 and by the engagement between its square holes H and the sprockets 85. After fed to the bottom of the rack 81, the leader is turned by 180 degrees by a turn guide 87 provided at its bottom then fed upwardly.

The anti-meandering means 83 comprises arm support shafts 88 mounted alternately with the roller shafts 84, each shaft being provided with two pairs of film guide frames 89, 90, and a spring 91. The spring biasses a pair of downwardly extending film guide frames 89 obliquely toward a downward feed path and biasses a pair of upwardly extending film guide frames 90 obliquely toward an upward feed path. The film guide frames 89, 90 are pushed back by the leader L agiinst the bias of the springs 91, and recover to the original state after the leader L has passed, so as to guide the side edges of the filmsFF which follows the leader L by means of the tips of their opposite arms 92. The film feed mechanism 82 and the anti-meandering means 83 including a plurality of shafts 84, 88, respectively, have to be provided with supports for the shafts 84, 88. A conventional rack is, as shown in FIGS. 10, 11, formed in the form of a square tube by putting a pair of rack plates 100 and a pair of guide plates 101 together with screws. The rack plats 100 are formed with a plurality of shaft receiving holes so as to rotatably receive the ends of the shafts 84, 88.

The conventional film feed unit described above is very time-consuming to assemble because the shafts have to be inserted into the respective shaft receiving holes one by one. Further, as shown in FIG. 9, since the depths of the treating tanks are different, a rack to be hung down in each treating tank has to have the length which corresponds to the depth of the teeating tank. However, since it is difficult to change the length of a conventional rack comprising a pair of rack plates 100 and a pair of guide plates 101, a number of such racks having different lengths each corresponding to the depths of the treating tanks have to be assembled.

It is therefore an object of the present invention to provide a film feed unit which obviates the abovesaid shortcomings and in which a rack can be easily assembled and its length can be easily changed.

According to the present invention, the rack comprises a pair of rack plates provided with side plates formed with grooves which allow the film feed members to be mounted on the rack. Thus the film feed unit can be assembled very easily by inserting the film feed members into the grooves from the front of the side plates and by coupling the pair of rack plates together.

Further, the rack plates are longitudinally divide into a plurality of blocks, one of the rack plates being formed with grooves and the other of the rack plates with projections to be received in the grooves to couple the rack plates. Thus, the length of the rack is easily adjustable to the depth of a treating tank by changing the number of blocks.

The anti-meandering units according to the present invention can be assembled with a smaller number of parts very easily by inserting the insert pieces provided on the resilient plates into the holes formed in the surface for supporting the resilient plates. The tip of the resilient plate disposed into the feed path of films reliably prevents films from meandering.

Other features and objects of the present invention will become apparent from the following description taken with reference to the accompanying drawings, in which.

Figure 1:
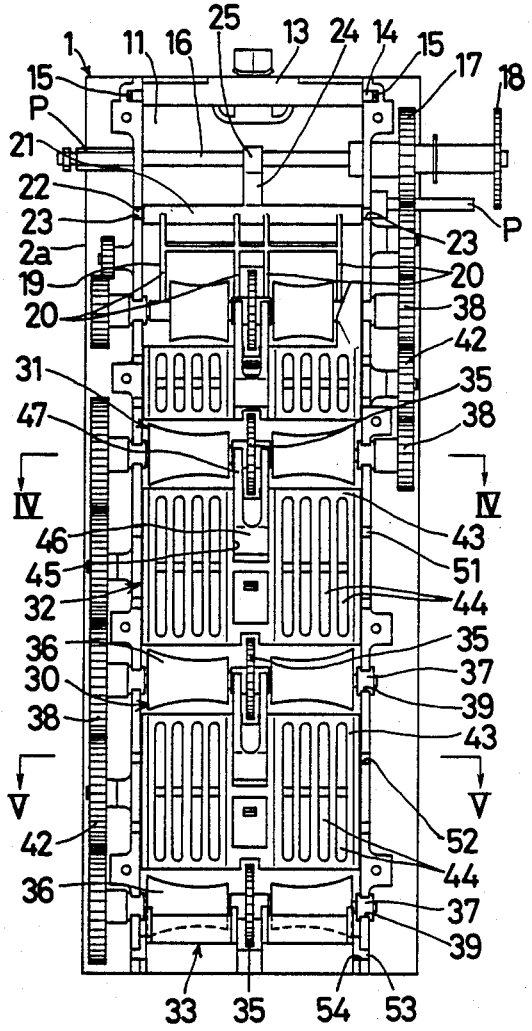
FIG. 1 is a front view of the film feed unit embodying the present invention.
Figure 2:
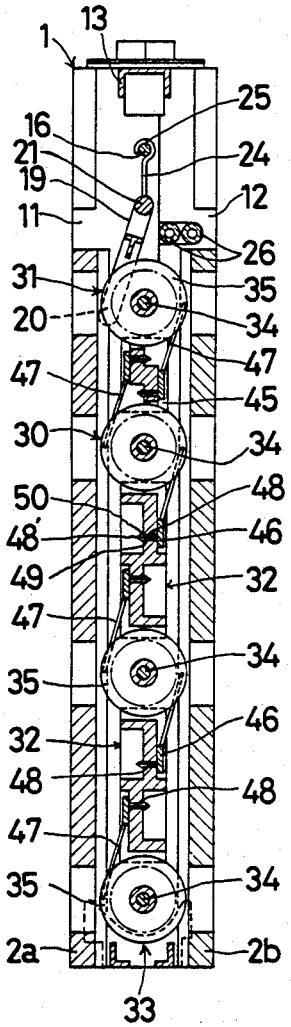
FIG. 2 is a vertical sectional side view of the same.
Figure 3:
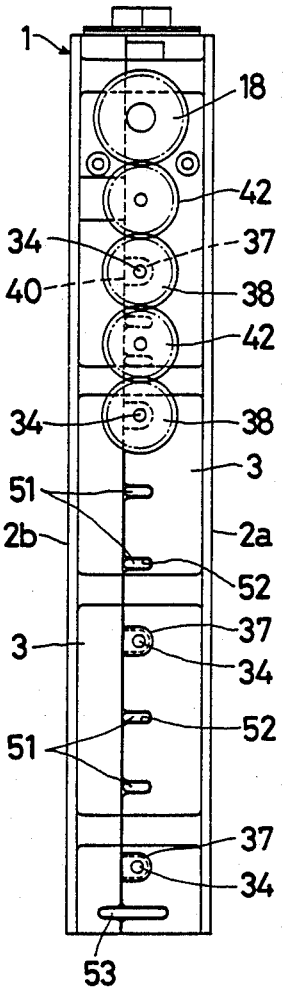
FIG. 3 is a side view of the same.
Figure 4:
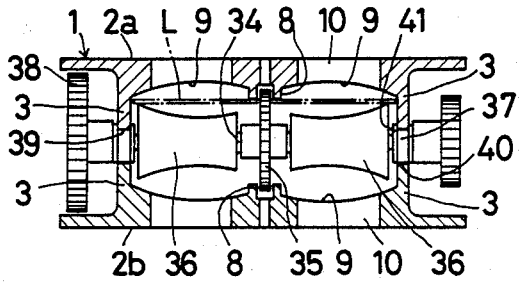
FIG. 4 is a sectional view taken along line IV—IV of FIG. 1.
Figure 5:
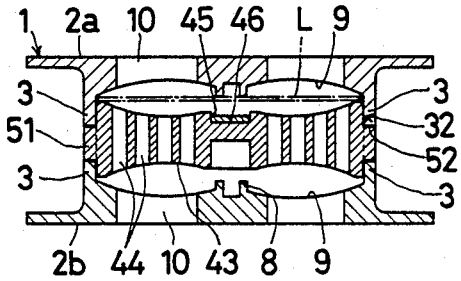
FIG. 5 is a sectional view taken along line V—V of FIG. 1.
Figure 6:
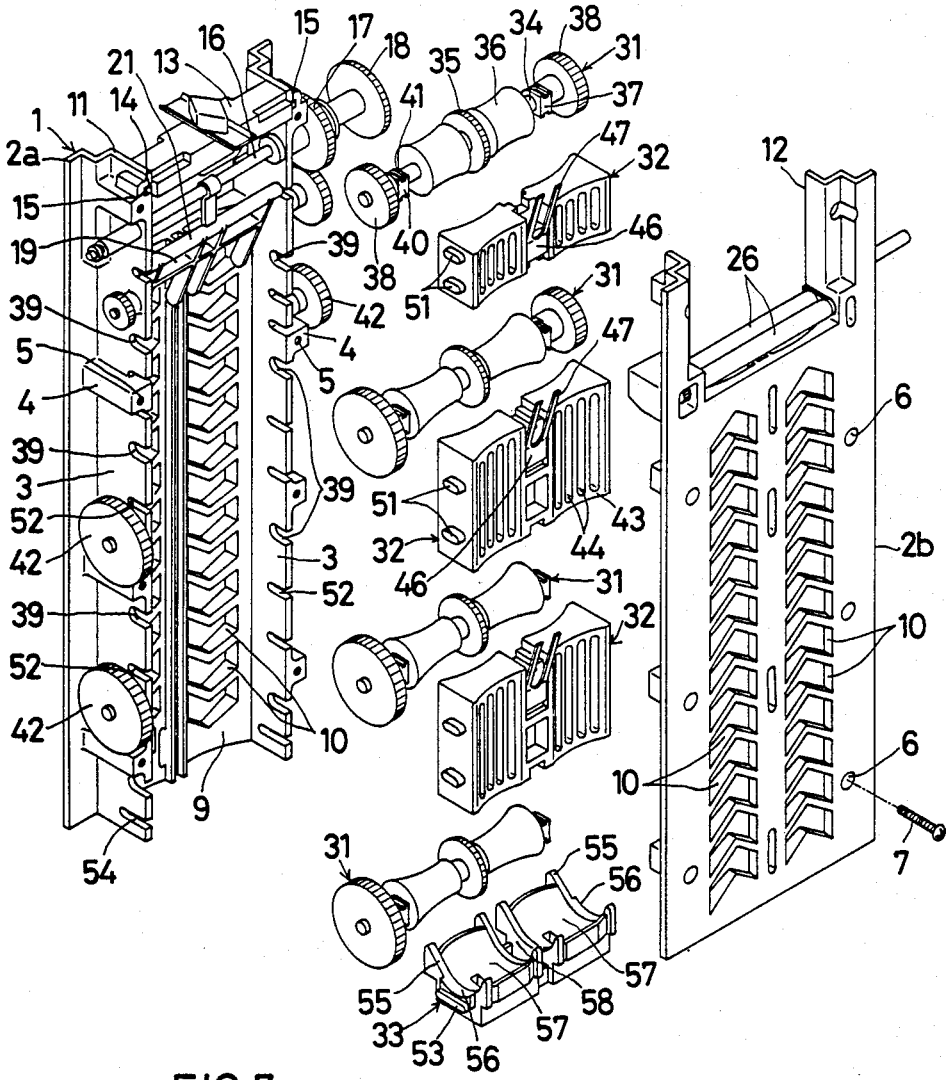
FIG. 6 is an exploded perpective view of the same.
Figure 7:
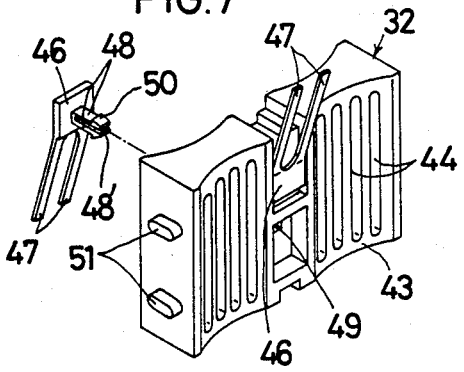
FIG. 7 is a perspective view of the guide block and the resilient plate.
Figure 9:
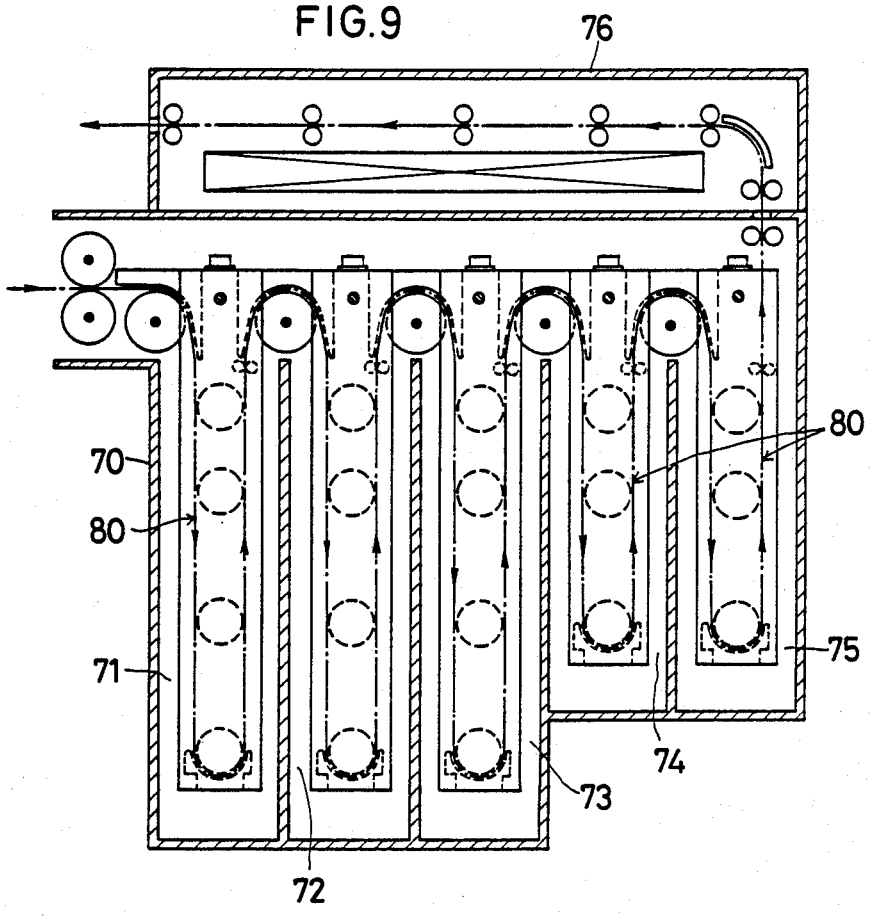
FIG. 9 is a vertical sectional front view showing an embodiment of an automatic film developing machine.

Referring to FIGS. 1 through 7, the film feed unit in accordance with the present invention, as best shown in FIGS. 1 to 3, comprises a rack 1 in the form of a square tube rack 1 and a film feed member 30 mounted in the rack 1. The rack 1 is hung in a treating tank of various kinds in the same manner as the rack shown in FIG. 9. As shown in FIG. 1, hanger pins P are provided at both sides of its uppermos part in order to hang the rack in a treating tank. Further, as best shown in FIGS. 4 to 6, the rack 1 comprises a pair of rack plates 2a, 2b, each being made of synthetic resin and provided with a pair of side plates 3 on the same surface.

The side plates 3 of the rack plate 2a are provided on their outer surface with a pluraiity of ribs 4 each formed with a tapped hole 5 in its end face (see FIG. 6). The other rack plate 2b is formed with screw holes 6 so as to oppose to the tapped holes 5. The rack plates 2a, 2b are put together by tightening screws 7 through the screw holes 6 into the tapped holes 5 to form the rack 1.

Each of the rack plates 2a, 2b has a pair of longitudinally extending ridges 8 on the center of its surface opposite to each other. (FIG. 4) At both sides of each pair of ridges 8 are formed concave surfaces 9 along which th films F are fed. When the films are fed, the other edge of a short leader L is guided along the intersections between the inner surfaces of the side plates 3 and the curved surfaces 9. As shown in FIG. 6, the curved surfaces 9 re formed with a plurality of through holes 10 longitudinally spaced from one another at equal intervals. The through holes 10 serve as the paths for a treatment liquid. Each through hole 10 is V-shaped in the direction of movement of the film fed along the inner surfaces of the rack plates 2a, 2b so as not to hinder a smooth feed of films.

As shown in FIGS. 1, 2 and 6, the upper portions of the rack plates 2a, 2b are cut out to define an inlet 11 and an outlet 12 for the film, respectively.

Bridging over the inlet 11 is a handle 13 formed on both ends with projections 14 received in guide grooves 15 formed at both sides of the inlet 11. Each guide groove 15 is formed with an opening at the front of each side plate 3 through which the projection 14 is inserted therein.

Below the handle 13 there is a drive shaft 16. Both ends of the drive shaft 16 are passed through the side plates 3 at both sides of the inlet 11. A gear 17 and a sprocket 18 are mounted on one end of the drive shaft 16 outside the side plate 3.

Further below the rotary shaft 16 is provided a guide member 19 to guide the film F fed into the rack 1 through the inlet 11. The guide member 19 has two pairs of arms 20 spacedly and parallelly arranged so as to allow the films F to pass. A shaft 21 supporting the top of each arm 20 is formed on both ends with small diameter pins 22, which are inserted into cutouts 23 formed in the side plates 3 of the rack plate 2 so as to be rotatably supported in the cutouts 23.

The shaft 21 is provided thereon with a resilient member 24 formed on its top with a hook 25 engaging the drive shaft 16 to urge the arms 20 to slant toward the inner surface of the rack plate 2a, bringing their tips into contact with the inner surface of the rack plate 2a. The leader L is fed along the inner surface of the rack plate 2a and forced in between the arms 20 and the rack plate 2a, pushing back the arms 20, causing the shaft 21 to rotate slightly, and in turn deforming the resilient member 24 into an arc shape. After the passing of the leader L, the shaft 21 is rotated by the restoring force of the deformed resilient member 24, allowing the arms 20 to get back to their original slanted state so as to guide both ends of the films F which follows the leader L. Thus the films F are fed straight without meandering.

The film feed mechanisms or members 30 mounted on the rack 1 guide the leader L fed into the rack 1 through the inlet 11 downwardly along the inner face of the rack plate 2a untll it reaches the bottom of the rack 1. The leader is then turned by 180 degrees and fed upwardly along the inner surface of the rack plate 2b through a pair of squeeze rollers 26 to the outlet 12.

Figure 10:
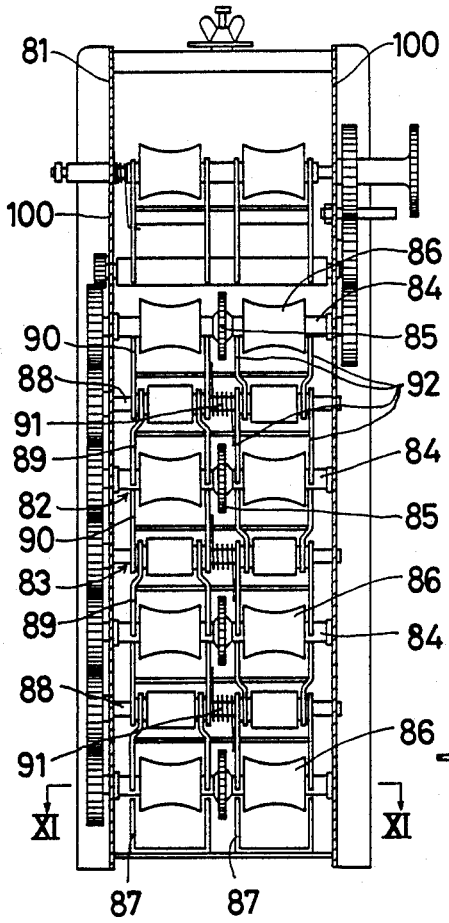
FIG. 10 is a vertical sectional front view of a prior art film feed unit.
Figure 11:
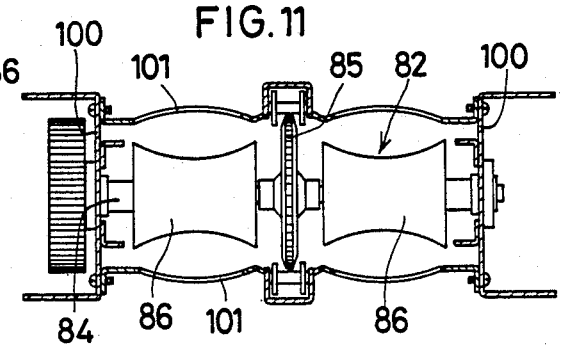
FIG. 11 is a sectional view taken along line XI—XI of FIG. 9.

As a film feed mechanism 30, either one of the mechanisms shown in FIGS. 10, 11 or the one disclosed in the Japanese Not-examined Patent Publication No. 60-191259 may be empolyed. In the preferred embodiment, the film feed mechanism comprises a plurality of sprocket assemblies 31, a plurality of intermediate guides 32 and a turn guide 33.

As shown in FIGS. 4 and 6, each sprocket assembly 31 comprises a shaft 34, a sprocket 35 mounted on the center of the shaft 34, a pair of hourglass-shaped crown rollers 36 of a soft material mounted on the shaft at both sides of the sprocket 35 to guide the side edges of a film, bearings 37 in which both ends of the shaft 34 are rotatably received, and gears 38 fixed to the shaft 34 outside the bearings 37 to transmit torque.

The bearings 37 are received in cutouts 39 formed in the side plates 3 of the rack plate 2a. The cutouts 39 are spaced apart from each other by a predetermined distance and are open at the front edge of the side plate 3. Each bearing 37 can be inserted into each cutout 39 through the opening at front. A flat surface 40 forming a part of the periphery of each bearing 37 inserted into each cutout 39 will be flush with the front edge of the side plate 3. A pair of ridges 41 formed on both sides of the periphery of each bearing 37 engage both surfaces of the side plate 3, thus preventing the bearings 37 from moving to either side of the cutouts 39.

With the sprocket assemblies 31 mounted on the rack plate 2a, the gears 38 at both ends of the sprocket assemblies 31 engage rotatable idle gears 42 supported on the outer surface of the side plates 3 of the rack plate 2a as shown in FIG. 1. Thus, by rotating the rotary shaft 16, the shafts 34 of the sprocket assemblies 31 can be rotated.

As shown in FIG. 1, the intermediate guides 32 are arranged alternating with the sprocket assemblies 31. As shown in FIG. 5, each intermediate guide 32 is formed with concave arcuate surfaces 43 on both sides so as to face the curved surfaces 9 on the rack plate 2a. In the arcuate surfaces 43 are formed a plurality of vertically extending slits 44 spaced apart at equal intervals, through which a treatment liquid flow. Each intermediate guide 32 is formed in the center of both sides with recesses 45 (FIG. 5), each provided with a resilient plate 46 (FIG. 7) having one end secured to the bottom surface of the recess 45 and the other end formed with a forked piece 47. As shown in FIG. 2, the forked pieces 47 of the resilient plates 46 on one side are extending obliquely upwardly and the forked pieces of the resilient plates on the other side are extending obliquely downwardly.

As seen from FIG. 2, each resilient plate 46 is provided at the end portion on one side with an insert piece 48 formed with an expanding slot 48' which is adapted to be received in a hole 49 formed in the bottom surface of the recess 45 and engage the edge of the opening of the hole 49 by a hooked portion 50 provided at the tip of each insert piece 48.

Each intermediate guide 32 is formed on each side wall with a pair of vertically arranged projections 51 adapted to be received in cutouts 52 formed in the side plates 3 of the rack plate 2a. The cutouts 52 and the cutouts 39 for the bearing are arranged alternately. The cutouts 52 are open at the front of the side plates 3, through which the projections 51 are inserted into the cutouts 52 to fixedly mount the intermediate guides 32. In mounting the intermediate guides 32, it is necessary to make sure that the resilient plates 46 are orientated so that the forked piecss 47 will slant in the direction of feed of the film F.

The forked piece 47 provided at the tip of each resilient plate 46 is so adapted to be inserted between the two films F connected to the leader L. Each forked piece 47 is inclined in the direction of feed of the films F so that its tip will engage the outer periphery of each sprocket 35 located ahead of it. Also the tip of each forked piece 47 is protruded into the feed path of the films F to guide their side edges. Each forked piece 47 is pushed by the tip of the leader L to deform and get out of the feed path when the leader L reaches the resilient plate 46 protruding into the feed path of the films F.

After the passing of the leader L, each resilient plate 46 is restored to its original state by its resilience to extend again into the feed path of the films F. Thus the films F guided by the tip of the forked pieces 47 at their edges can be smoothly fed without meandering.

In this embodiment, the resilient plates 46 are mounted on the intermediate guides 32. They may be mounted on the inner or outer surfaces of the rack plates *2a, 2b* instead. If mounted on their outer surfaces, the rack plates should be formed with holes which allow the tip of the resilient plates to pass through and protrude into the feed path of films. The forked pieces 47 may be omitted according to the position of the resilient plates mounted on the rack plate.

The turn guide 33 is mounted between the lower portions oof the side plates 3 of the rack plate *2a,* as shown in FIG. 1, and is formed at both sides with projections 53 which are inserted into cutouts 54 formed in the lower portions of the side plates 3. The cutouts 54 are open at the front of the side plates 3 through which the projections 53 are inserted. Also provided at both sides of the turn guide 33 are a pair of flanges 55 each formed with an arcuate leader guide surface 56 on its top edge. (FIG. 6)

Further the turn guide 33 has a pair of arcuate guide portions 57 on its top between the pair of flanges 55 to guide the film F which follows the leader L. Between the pair of arcuate guide portions 57, there is provided a guide groove 58 into which the lower part of the periphery of the sprocket 35 on the spoocket assembly 31 located right above the turn guide 33 is inserted.

Figure 8:
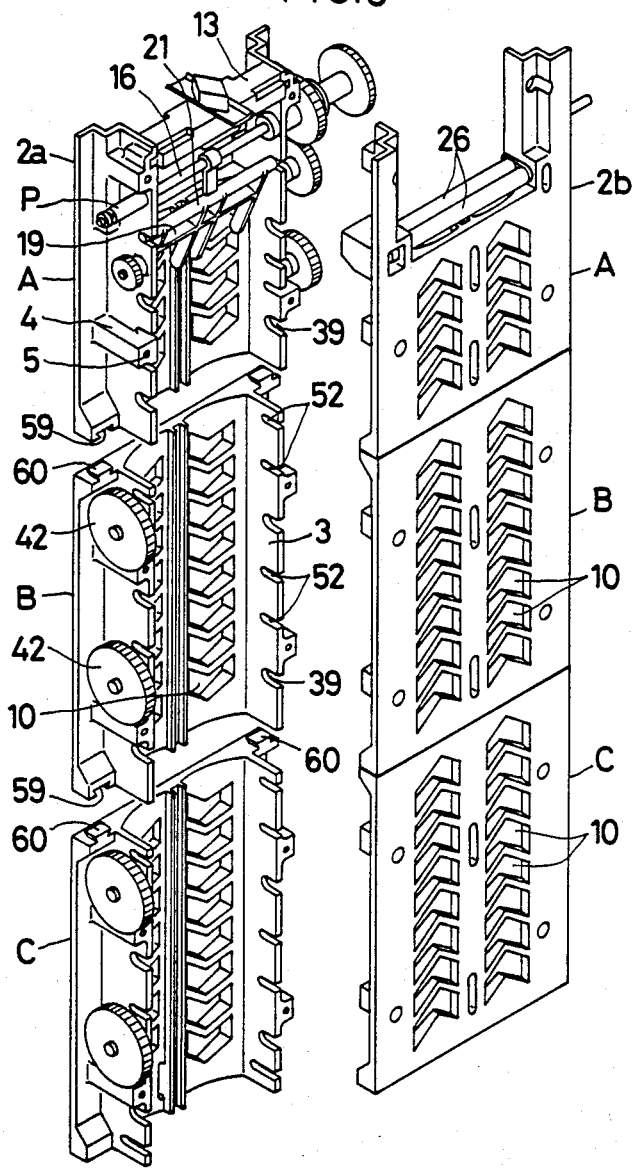
FIG. 8 is an exploded perspective view of another embodiment of the rack plate.

FIG. 8 shows another embodiment of the rack plates *2a, 2b* in which the rack plates *2a, 2b* are divided into a plurality of blocks in a longitudinal direction. Each divided block is formed in one of its two cut surfaces with grooves 59 and on the other surface with projections 60 to be engaged in the grooves 59 to form the rack plates *2a* and *2b.*

The rack plates *2a, 2b* should be divided into three or more blocks, that is, an upper block A, an intermediate block or blocks B and a lower block C. It is preferable to prepare a plurality of intermediate blocks B of the same configuration. The upper block A, the intermediate blocks B and the lower block B are put together to form a rack plate. The length of the rack plate is variable by changing the number of intermediate blocks B.

Upon completion of the rack plates *2a, 2b,* the side plates 3 of the rack plate *2a, 2b* are butted together and then screws are tightened through the screw holes 6 in the rack plate *2b* into the tapped holes 5 in the rack plate *2a* to clamp them together into the shape of a square tube.

In order to assemble the film feed unit as shown in FIG. 2, the sprocket assemblies 31 and the intermediate guides 32 are mounted between the side plates 3 of the rack plate *2a,* and the turn guide 33 is mounted between the lower portions of the side plates 3. The bearings 37 on both ends of the sprocket assemblies, the projections 51 of the intermediate guides 32 and the projections 53 of the turn guide 33 are inserted into cutouts 39, 52 and 54 formed in the side plates 3, respectively. Finally the rack plates *2a, 2b* are put together.

Figure 12:
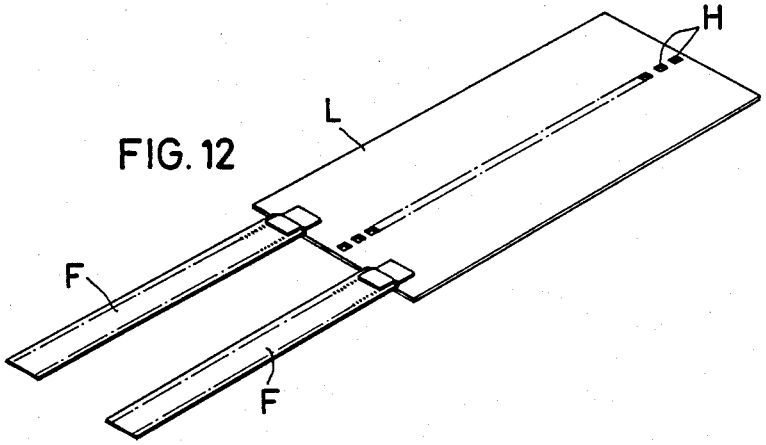
FIG. 12 is a perspective view of a leader connected to a film.

With the film feed unit mounted in each treatment tank of an automatic film developing machine, and with the sprockets 35 of the sprocket assemblies 31 rotating, the leader L shown in FIG. 12 is fed into the rack 1 through the inlet 11 at its top, so that the sprockets 35 are received in the square holes H formed in the leader L to feed the leader downwardly along the inner surface of the rack plate *2a* with the rotation of the sprockets 35. Arriving at the lowermost part of the rack 1, the leader changes its direction, guided by the turn guide 33, and fed upwardly along the inner surface of the rack plate *2b.*

When the leader L is passing between the rack plate *2a* or *2b* and the tip of each resilient plate 46, the resilient plate 46 deforms toward the sprocket 35. After its passing, the resilient plate 46 returns to its inclined state by its own resilience to come into contact with the side edges of the upcoming films F. Thus the films F are fed straight without snaking.

What are claimed are:

1. A film unit for use in an automatic film developing machine comprising a rack in the form of a square tube and a plurality of film feed members mounted in said rack with end portions thereof supported by said rack, characterized in that said rack is formed by a pair of rack plates provided with side plates, said side plates joining said rack plates and having cutouts into which said end portions of said film feed members are inserted for supporting said film feed members in said rack.

2. A film feed unit for use in a automatic film developing machine comprising a rack in the form of a square tube and a plurality of film feeding members mounted in said rack with end portions thereof supported by said rack, characterized in that said rack is formed by a pair of rack plates provided with side plates, said side plates joining said rack plates and having cutouts into which said end portions of said film feed members are inserted for supporting said film feed members in said rack, said pair of rack plates being divided into a plurality of portions each having one end formed with grooves and the other end formed with projections for receiving said grooves for assembling said rack plates.

* * * * *